US011090514B2

(12) United States Patent
Huner

(10) Patent No.: US 11,090,514 B2
(45) Date of Patent: Aug. 17, 2021

(54) STRIKING APPARATUS

(71) Applicant: M. J. Huner LLC, Chicago, IL (US)

(72) Inventor: Mitchell Huner, Chicago, IL (US)

( * ) Notice: Subject to any disclaimer, the term of this patent is extended or adjusted under 35 U.S.C. 154(b) by 170 days.

(21) Appl. No.: 15/661,387

(22) Filed: Jul. 27, 2017

(65) Prior Publication Data

US 2018/0214718 A1 Aug. 2, 2018

Related U.S. Application Data

(63) Continuation-in-part of application No. 29/592,671, filed on Feb. 1, 2017, now Pat. No. Des. 819,421.

(51) Int. Cl.

| | |
|---|---|
| ***A62B 3/00*** | (2006.01) |
| ***B25F 1/00*** | (2006.01) |
| ***B25G 1/01*** | (2006.01) |
| ***B26B 23/00*** | (2006.01) |

(52) U.S. Cl.

CPC ..... *A62B 3/005* (2013.01); *B25F 1/006* (2013.01); *B25G 1/01* (2013.01); *B26B 23/00* (2013.01)

(58) Field of Classification Search

CPC . A62B 3/005; B25F 1/006; B25F 1/00; B25G 1/01; B26B 23/00; B25D 1/02; B25D 7/00; B66F 15/00; B25C 11/00; A01B 1/20; A62C 8/00; B26L 7/00; B26L 7/005; B26L 7/06; B26L 7/08

USPC ..... 7/145, 144, 146; 30/308.1; 144/193.1, 144/193.2

See application file for complete search history.

(56) References Cited

U.S. PATENT DOCUMENTS

| | | | | | |
|---|---|---|---|---|---|
| D33,137 | S | * | 8/1900 | Duffy | D8/76 |
| 755,355 | A | * | 3/1904 | Carlsen | |
| 946,565 | A | * | 1/1910 | Sayre | B26B 23/00 7/122 |
| 1,088,938 | A | * | 3/1914 | Seelye | B26B 23/00 30/308.3 |
| 1,174,120 | A | * | 3/1916 | Chaffin | B26B 23/00 7/122 |
| 1,272,538 | A | * | 7/1918 | Sandidge | B26B 23/00 30/308.1 |
| 3,604,028 | A | * | 9/1971 | Wardwell | B26B 23/00 7/145 |
| 4,044,808 | A | * | 8/1977 | Kolonia | B26B 23/00 30/308.1 |
| 4,383,562 | A | * | 5/1983 | Hockman | B26B 23/00 144/195.5 |
| 4,440,205 | A | * | 4/1984 | Hillinger | B27L 7/06 144/195.7 |

(Continued)

*Primary Examiner* — Joseph J Hail
*Assistant Examiner* — Arman Milanian
(74) *Attorney, Agent, or Firm* — Au LLC; Adam E. Urbanczyk

(57) ABSTRACT

A striking apparatus has a head composed of fore, mid, and aft portions with transition portions existing at the fore-mid and aft-mid junctions. The fore portion has a striking face the apex of which is a piecing edge. The striking face tapering into splitting edges away from the piercing edge. The fore portion having two sides on each of which a channel disposed for receiving the prongs of a provided tool. The longitudinal shoulders prevent the head from becoming embedded into a struck surface past the fore portion and act as fulcra for the user to more-easily retrieve the striking apparatus by lifting the striking apparatus handle.

9 Claims, 4 Drawing Sheets

(56) References Cited

U.S. PATENT DOCUMENTS

| | | | | |
|---|---|---|---|---|
| 4,926,558 | A * | 5/1990 | Brace | B26B 23/00 144/195.5 |
| 6,367,107 | B1 * | 4/2002 | Corsini | A62C 8/00 7/143 |
| D475,592 | S * | 6/2003 | Spencer | D8/47 |
| 6,718,586 | B2 * | 4/2004 | Corsini | A62C 8/00 7/143 |
| D566,510 | S * | 4/2008 | Nielsen | D8/76 |
| D644,498 | S * | 9/2011 | Chen | D8/78 |
| D661,170 | S * | 6/2012 | Beggs | A01G 23/099 D8/78 |
| 8,794,597 | B1 * | 8/2014 | Ingesson | A62B 3/005 254/104 |

* cited by examiner

STRIKING APPARATUS

CROSS REFERENCE TO RELATED APPLICATION

This application is a continuation in part of U.S. patent application Ser. No. 29/592,671 filed Feb. 1, 2017 which is still pending.

BACKGROUND OF THE INVENTION

Field of the Invention

This invention generally relates to striking tools and, particularly, to though used in demolition, security, and fire rescue activities.

Description of Problems with the Prior Art

Axes, sledgehammers, mattocks, and other striking tools are well known in the art. Generally, they comprise a head piece mounted to a handle, the head piece being configured to performing a specific function, e.g., splitting wood, applying crushing blunt force, or cutting materials. They are operated by the user angularly accelerating the head by means of the handle, the head being directed toward the target object. The inherent mechanical function of such tools relies on them impacting the target object on which significant force is applied. Where the target object is not readily frangible, the striking tool head will often become embedded into the target object slowing or preventing the user from extracting the tool head and continuing in his task. In certain situations, particularly fire rescue operations, a tool becoming inextricably embedded can create or exacerbate life threatening situations.

Certain examples in the prior art help illustrate common limitations with previous attempts to improve on the function of striking tools. U.S. Pat. No. 4,440,205 discloses a Wedge and Axe Head. This reference describes an axe head that comprises a pair of levers which help to split the target object, in this case wood. The head has a set of lateral ribs which act to shield the levers from the splitting wood advancing on either side of the head. The ribs neither prevent the head from advancing into the target object, but facilitate the head continuing advancing into the target object by allowing the levers to work to further split the wood apart and around the head cutting surface.

U.S. Pat. No. 4,926,558 discloses an Axe Maul Apparatus. This reference describes an axe head the cutting surface of which is configured with one or more penetration points enhancing the head's penetrating capability. Ribs are disposed along the sides of the head to reduce the surface area of the head that is in contact with the head's target object (i.e., it "rides over") during penetration. Like U.S. Pat. No. 4,440,205, this reference discloses features which encourage the head to continue into the target object as far as the head's momentum will allow upon striking, and contemplate complete obliteration or explosion of the target object obviating any extraction of the head. When the target object does not explode, the user is left prying the head out of the target object.

A review of the foregoing references and the rest of the prior art reveals that existing striking apparatus technology is not designed to prevent striking heads from becoming substantially embedded. Indeed, existing technologies are adapted to improving splitting function to the point where the target object will be substantially fragmented or obliterated, leaving nothing left into which the head could become embedded. Because many, if not most, occasions on which a striking apparatus might be used will not involve a singular target object or multiple target objects which a striking apparatus user desires to obliterate or explode, existing designs fail to be comprehensive of mechanical actions a user will want to exert on his environment.

BRIEF SUMMARY OF THE INVENTION

The present invention is a striking apparatus comprised of a head and a handle. The head has fore, mid, and aft portions. The fore portion has two sides, forming a blade-like extension from the mid portion. A transition portion exists between the fore and mid portions on which at least two shoulders are formed as the mid portion transitions into the fore portion. The fore portion has a striking means that comprises a longitudinal arcuate striking face. At the lateral apex of the arcuate striking face is a piercing edge, that edge tapering into a splitting edge in both directions along the arcuate striking face. The head is adapted to receive a handle, the handle being used to angularly accelerate the head against a target object. On impact, the piercing edge leads and penetrates into the target object. As the piercing edge penetrates, the target object is split along the tapering arcuate striking face and sides of the fore portion until it meets the shoulders, limiting the head's overall penetration into the target object and helping to prevent the head from becoming embedded therein. However, to assist with removing the head from the target object in the case the head becomes embedded, the user may simply lift the handle away from the target object whereby the shoulders act as fulcra against the target object allowing the fore portion to be rotated out of the target object.

The fore portion has a channel on either side into which tines of a forked tool may be secured. The fore, mid, and aft portions share a continuous, flat top surface to enable the striking apparatus to be used as a ram. The striking apparatus may be used to breach a door It is an object of the invention to provide a striking apparatus free from the limitations of standard axe-type and splitting striking tools. It is another object of the invention to teach a method of using a striking tool, as described herein, in door breaching procedures as may be used in demolition, security, or fire rescue operations. It is another object of the invention to teach a method of using a striking apparatus, as described herein, to strike a target object and then remove the partially-embedded striking apparatus by means of the shoulder features acting as fulcra and the striking apparatus' handle as a lever. Further objects and features of this invention will become more apparent upon considering the following drawings and description.

BRIEF DESCRIPTION OF THE DRAWINGS

The accompanying figures and drawings, incorporated into and forming part of the specification, service to further illustrate the present invention, its various principles and advantages, and its varying embodiments.

DETAILED DESCRIPTION OF THE INVENTION

Figure 1:
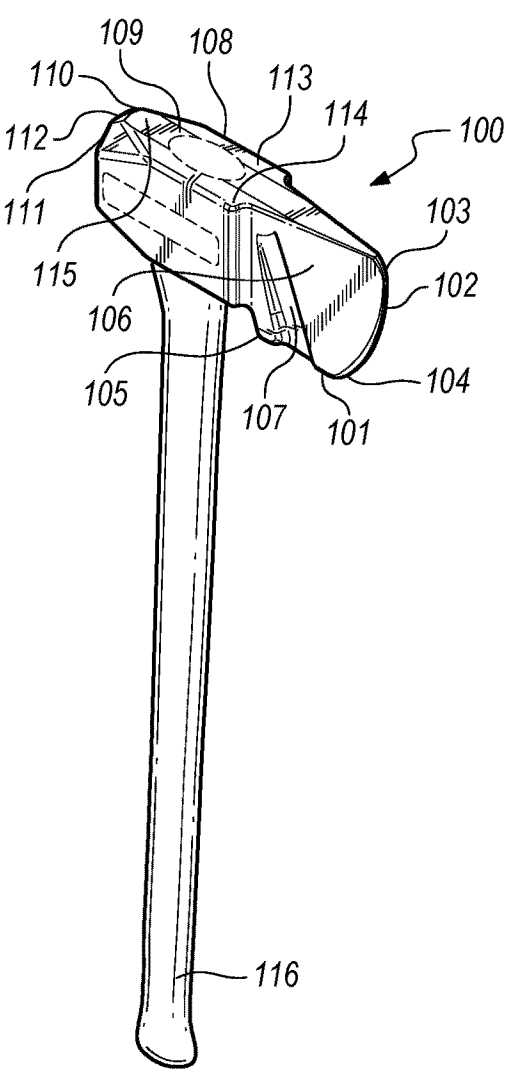
FIG. 1 illustrates an isometric view of an exemplary striking apparatus.

Provided is a striking apparatus the head one embodiment of which is illustrated in FIG. 1. The striking apparatus head is comprised of fore portion 100, mid portion 108, and aft portion 110. The fore portion has a first striking means 101, the first striking means comprises a longitudinal arcuate striking face 102 the apex of which forms a piercing edge 103. The piercing edge tapers to a splitting edge 104 in either direction along the longitudinal arcuate striking face. The longitudinal arcuate striking face extends below the mid portion to form a chin 105. On the fore portion is a first side 106 bearing a first channel 107. A longitudinal journal 109 is formed within the mid portion. A first transition portion 113 exists between the fore portion and mid portion, a first pair of longitudinal shoulders 114 existing within the first transition portion. The fore portion, mid portion, and aft portion share a continuous flat top surface 115. A handle 116 is disposed within the longitudinal journal. On the aft portion exists a second striking means 111, in this embodiment a maul means 112.

Figure 2:
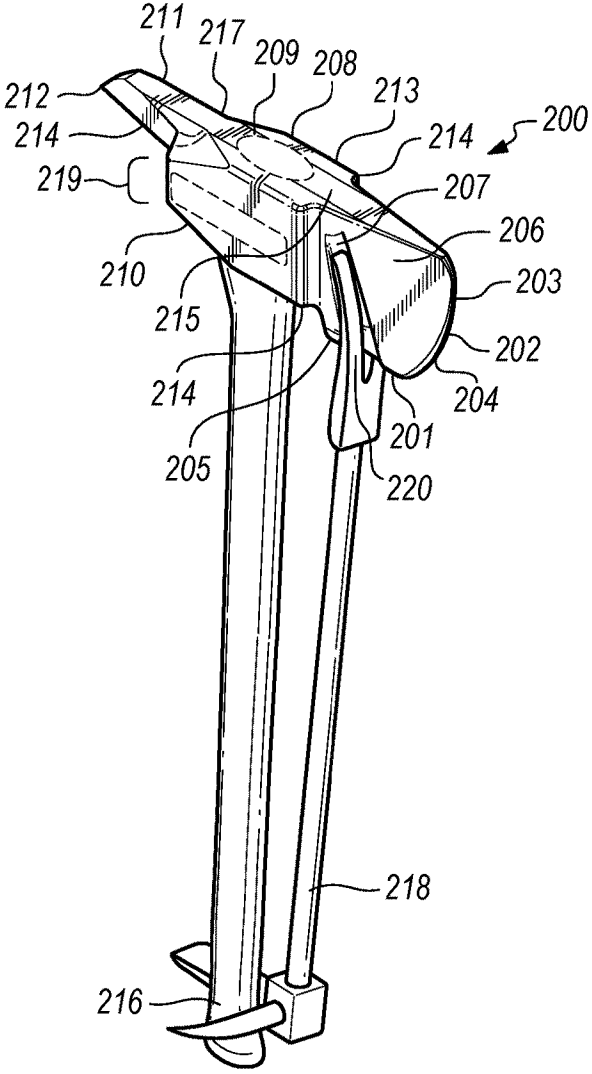
FIG. 2 illustrates an isometric view of an exemplary striking apparatus.

Another embodiment of the striking apparatus appears in FIG. 2. There shown is a head having a fore portion 200, mid portion 208, and aft portion 210. A first striking means 201 comprises a longitudinal arcuate striking face 202 which at its apex bears a piercing edge 203 tapering into a splitting edge 204 in both directions along the longitudinal arcuate striking face. The longitudinal arcuate striking face extends below the mid portion forming a chin 205. The fore portion has a first side 206 on which a first channel 207 is disposed. A longitudinal journal 209 is formed within the mid portion. The aft portion bears a second striking means 211, in this case a spike 212. A first transition portion 213 exists between the fore portion and the mid portion, and thereon exists first longitudinal shoulders 214. A second transition portion 217 exists between the mid portion and the aft portion, and thereon also exists second longitudinal shoulders 219. The fore portion, mid portion, and aft portion share a flat top surface 215. A handle 216 is disposed within the longitudinal journal. Prongs 220 of a Halligan-type bar 218 secure it between the handle and the first channel.

Figure 3:
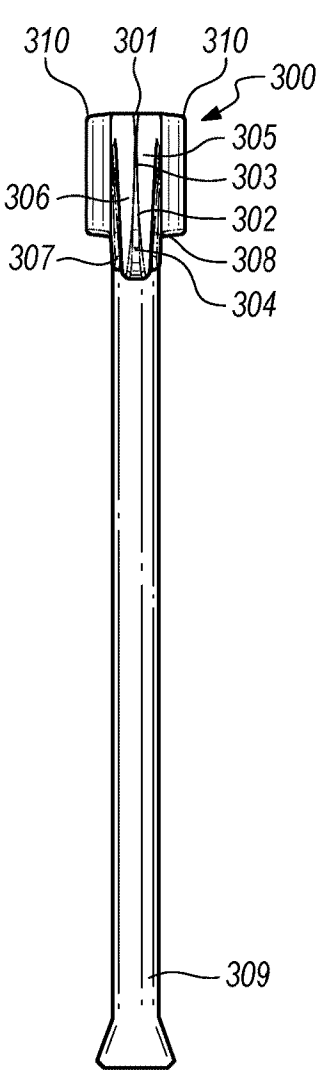
FIG. 3 illustrates a frontal view of an exemplary striking apparatus.

FIG. 3 shows a frontal view of the embodiment of FIG. 1. There shown is a head having a fore portion 300 with a first striking means 301 bearing a longitudinal arcuate striking face 302 extending from longitudinal shoulders 310. A piercing edge 303 tapers to splitting edges 304 along the longitudinal arcuate striking face. The fore portion has a first side 306 and a second side 305 on which a first channel 307 and second channel 308 are disposed, respectively. A handle 309 extends into the head.

Figure 4:
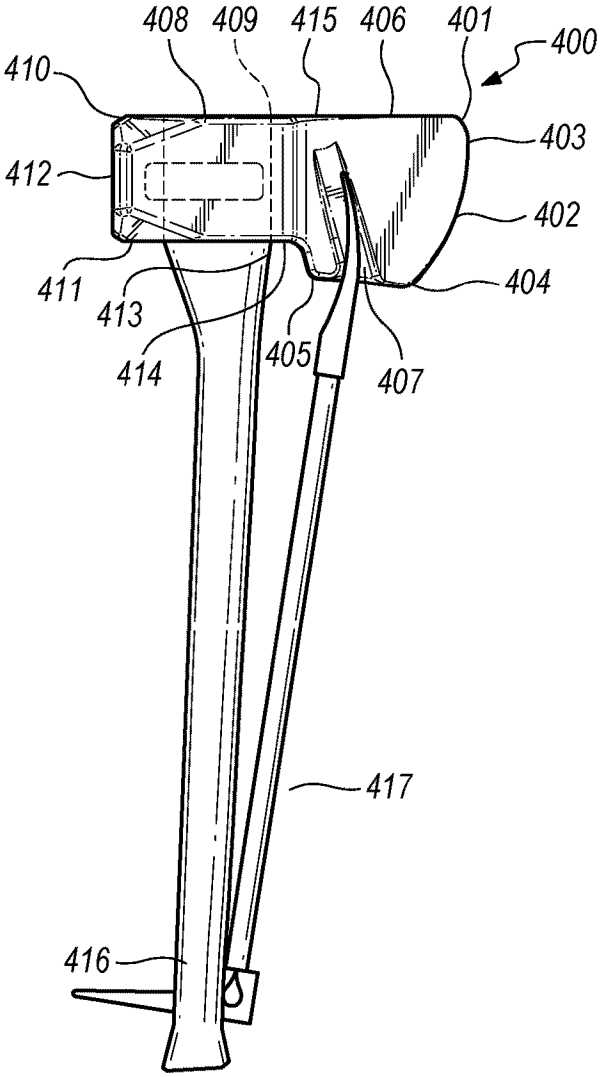
FIG. 4 illustrates a side view of an exemplary striking apparatus.

FIG. 4 shows a side view of a head having an aft portion 410, mid portion 408, and fore portion 400 with a first striking means 401 comprising a longitudinal arcuate striking face 402. A piercing edge 403 tapers to splitting edges 404 along the longitudinal arcuate striking face. A chin 405 extends below the mid portion. The fore portion has a first side 406 on which a first channel 407 is disposed. A longitudinal journal 409 is formed within the mid portion. A first transition portion 413 exists between the fore portion and the mid portion that bears first longitudinal shoulders 414. The fore portion, mid portion, and aft portion 410 share a flat top surface 415. The aft portion has a second striking means 411 having a maul means 412. A Halligan bar 417 is secured against a handle 416 and within the first channel.

Figure 5:
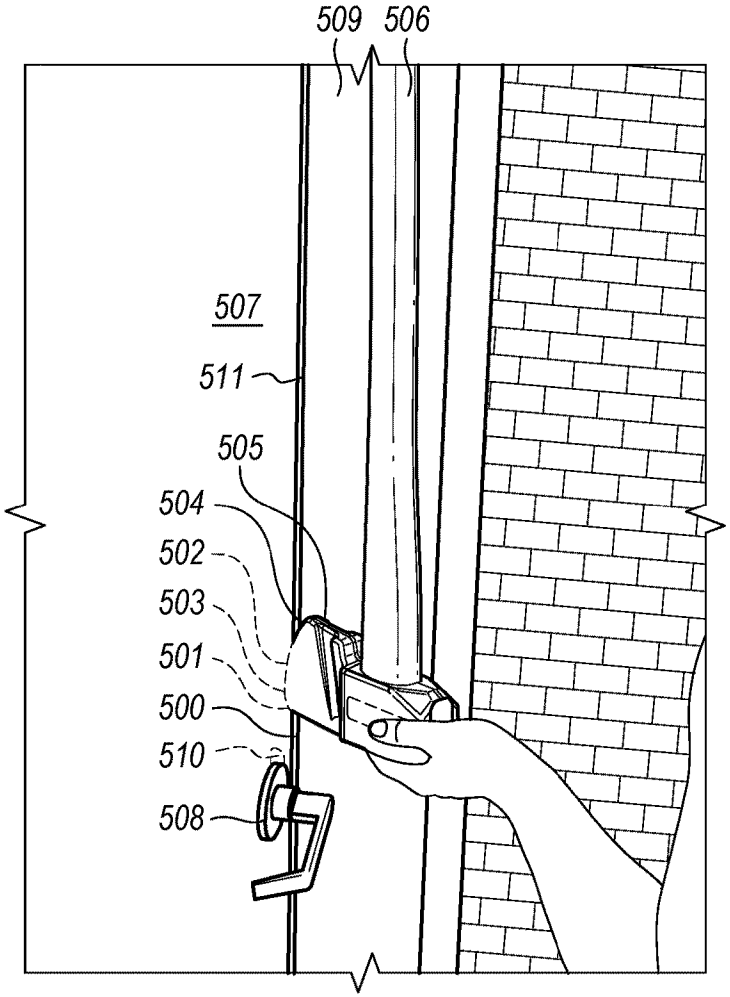
FIG. 5 illustrates a cross sectional view of the striking apparatus piercing a door seam.

FIG. 5 illustrates a method of breaching a door using a striking apparatus as described herein. The fore portion 500 of a tool head bears a first striking means 501 comprising a longitudinal arcuate striking face 502 forming a chin 505 below the fore portion. A piercing edge 503 that tapers to splitting edges 504 is placed in the seam 511 between the door 507 and door frame 509. The user grips the head and handle 506. The door handle 508 is engaged with the door frame receiver 510.

Figure 6:
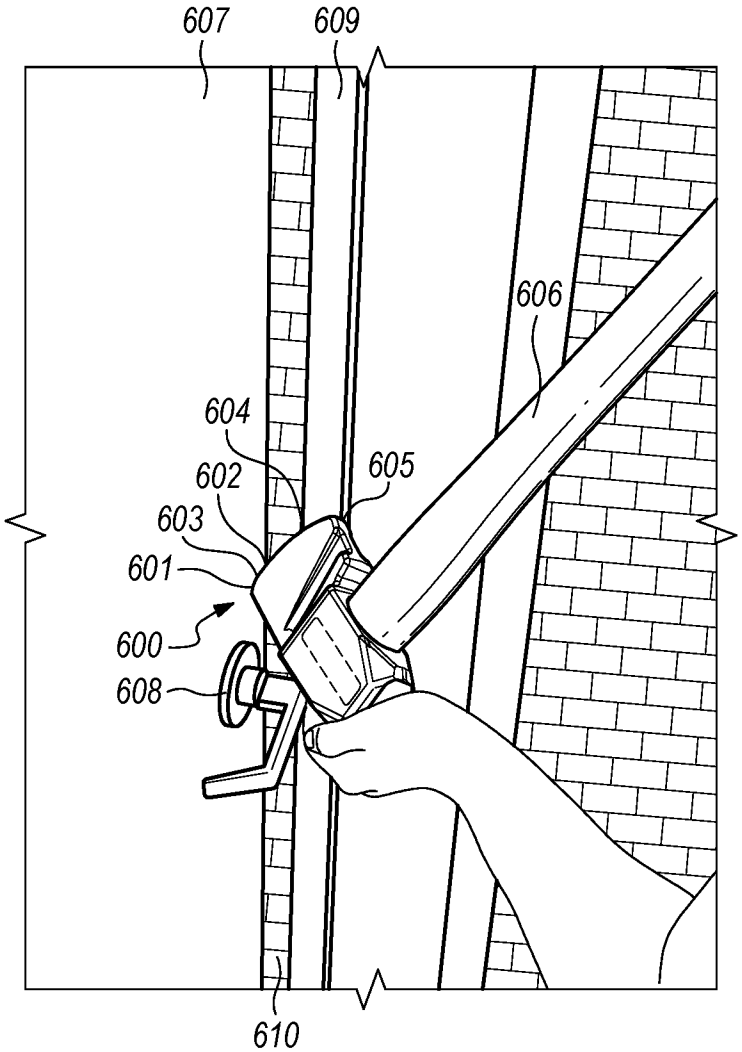
FIG. 6 illustrates a striking apparatus being rotated to separate a door from a door frame.

FIG. 6 illustrates the following acts of the method illustrated in FIG. 5. The fore portion 600 of the head has a first striking means 601 bearing a longitudinal arcuate striking face 602 ending in a chin 605 below the fore portion. The piercing edge 603 has been advanced into the seam as the door 607 and door frame 609 and separated by the splitting edges 604. The user further turns the handle 606 to gain mechanical advantage to separate the door from the door frame, as well as the door fastening mechanism 608 from the door frame, creating a breach 610. The user may then advance the door through the door frame.

Figure 7:
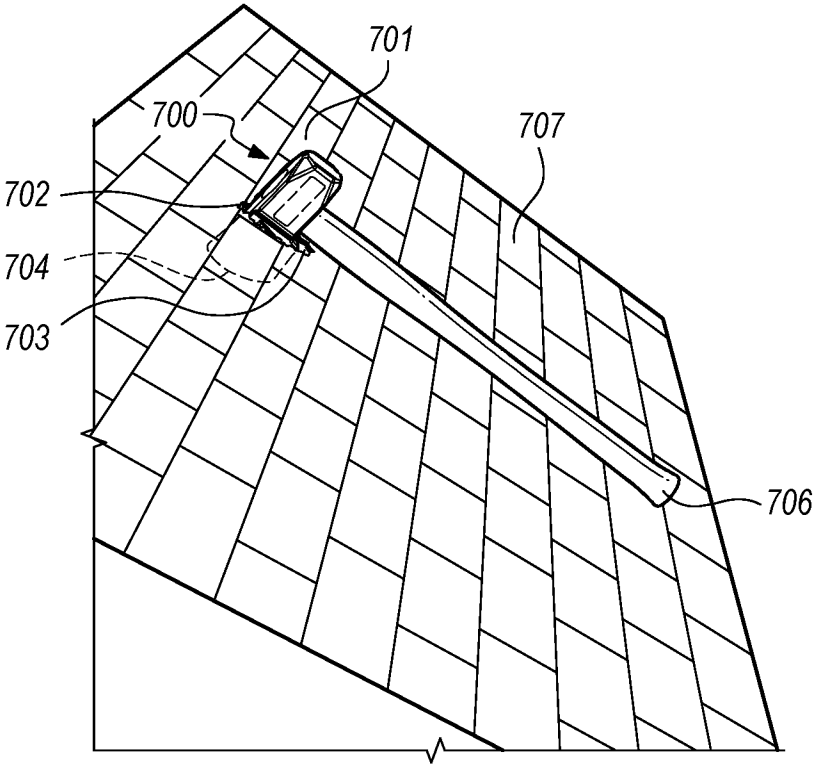
FIG. 7 illustrates a striking apparatus head embedded into a striking surface.

FIG. 7 illustrates use of the striking apparatus as described herein against a striking surface 707, in this case a shingled roof. Using the handle 706, a user has embedded the fore portion 704 into the striking surface until the first transition portion 702 that bears the first longitudinal shoulders 703, leaving the head's aft portion 701 exposed above the striking surface. Because the width of the first longitudinal shoulders is substantially greater than that of the first portion, a striking surface upon being punctured will pass over the first side and second side of the fore portion but stop upon encountering the first longitudinal shoulders. This prevents the head from becoming completely embedded or, otherwise, inextricably embedded.

Figure 8:
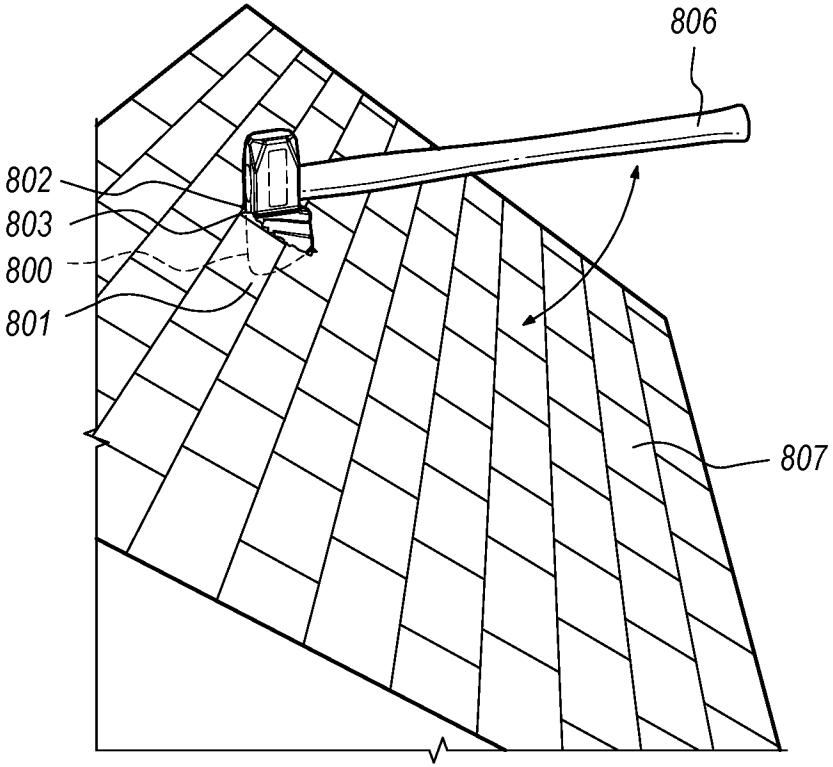
FIG. 8 illustrates a striking apparatus being rotated out of a striking surface.

FIG. 8 illustrates the following acts of the method illustrated in FIG. 7. A head fore portion 800 has been embedded into a striking surface 807. The head's first striking means 801 has pierced through the striking surface however the longitudinal shoulders 803 prevent the head from embedding into the striking surface beyond the first transition portion 802. Lifting the handle 806 causes the head to utilize the longitudinal shoulders as a fulcrum and lift the embedded first striking means out from beneath the striking surface.

The head, as illustrated herein, may be made from any material suitable for striking purposes which generally comprise durable metal alloys (e.g., rolled steel and titanium alloys). The handle may generally be made from wood, fiberglass, laminated carbon fiber, or other materials which are shock resistant and/or have vibration-dampening characteristics. The handle may be secured within the longitudinal journal of the head by adhesive and/or collared means as described in U.S. patent application Ser. No. 15/016,240.

While the striking apparatus invention and methods of use thereof have been described with reference to certain embodiments, various modifications thereof will be apparent to those skilled in the art without departing from the scope of the invention.

I claim:

1. A striking apparatus comprising:

a head comprising a fore portion, a mid portion, and an aft portion, the head further comprising a first transition portion between the mid portion and the fore portion, the first transition portion forming first longitudinal shoulders between the mid portion and the fore portion;

the fore portion, mid portion, and aft portion sharing a continuous flat top surface to enable the striking apparatus to be used as a ram, and wherein the continuous flat top surface is planar;

a longitudinal journal formed in the mid portion adapted to receive a handle;

the fore portion comprising a first striking means, the first striking means comprising a longitudinal arcuate striking face, the longitudinal arcuate striking face at its apex comprising a piercing edge located substantially towards the top of the longitudinal arcuate striking face, the piercing edge tapering into a splitting edge in both directions along the longitudinal arcuate striking face, the longitudinal arcuate striking face extending below the mid portion forming a chin, each of the first longitudinal shoulders between the mid portion and the fore portion forming an arresting surface, substantially perpendicular to the fore portion, wherein the arresting surface prevents the mid portion from advancing into an object impacted by the first striking means, wherein width and height of the arresting surface is equal to the width and height of the mid portion, wherein the first longitudinal shoulders extend vertically between the flat top surface and the bottom of the mid portion;

the fore portion further comprising a first side and a second side;

a first channel disposed onto the first side extending from the bottom of the fore portion substantially towards the flat top surface of the fore portion;

a second channel disposed onto the second side extending from the bottom of the fore portion substantially towards the flat top surface of the fore portion, the second channel with the first channel adapted to receive a forked end of a tool placed against the bottom of the fore portion;

the aft portion comprising a second striking means; and a handle secured within the longitudinal journal.

2. The striking apparatus of claim 1, wherein the second striking means comprises a maul means.

3. The striking apparatus of claim 1, wherein the head further comprising a second transition portion forming at least two shoulders between the mid portion and the aft portion, each of the at least two shoulders between the mid portion and the aft portion forming second longitudinal shoulders that prevents the mid portion from advancing into an object impacted by second striking means, the second striking means comprising a spike.

4. A method of breaching a door comprising the steps of:

providing a striking apparatus, the striking apparatus comprising a head, the head comprising a fore portion, a mid portion, and an aft portion, the head further comprising a first transition portion between the mid portion and the fore portion, the first transition portion forming first longitudinal shoulders between the mid portion and the fore portion, the fore portion, mid portion, and aft portion sharing a continuous flat top surface to enable the striking apparatus to be used as a ram, and wherein the continuous flat top surface is planar, the head further comprising a longitudinal journal formed in the mid portion adapted to receive a handle, the fore portion comprising a first striking means, the first striking means comprising a longitudinal arcuate striking face, the longitudinal arcuate striking face at its apex comprising a piercing edge located substantially towards the top of the longitudinal arcuate striking face, the piercing edge tapering into a splitting edge in both directions along the longitudinal arcuate striking face, the longitudinal arcuate striking face extending below the mid portion forming a chin, the fore portion further comprising a first side and a second side, the head further comprising a first channel disposed onto the first side extending from the bottom of the fore portion substantially towards the flat top surface of the fore portion, each of the first longitudinal shoulders between the mid portion and the fore portion forming an arresting surface, substantially perpendicular to the fore portion, wherein the arresting surface prevents the mid portion from advancing into an object impacted by the first striking means, wherein width and height of the arresting surface is equal to the width and height of the mid portion, wherein the first longitudinal shoulders extend vertically between the flat top surface and the bottom of the mid portion, the head further comprising a second channel disposed onto the second side extending from the bottom of the fore portion substantially towards the flat top surface of the fore portion, the second channel with the first channel adapted to receive a forked end of a tool placed against the bottom of the fore portion, the aft portion comprising a second striking means, the striking apparatus further comprising a handle secured within the longitudinal journal;

providing a door closed within a door frame, the door having at least one fastening mechanism, the door frame having at least one receiver for the at least one fastening mechanism;

introducing the piercing edge to a seam between the door and the door frame;

causing the piercing edge to impact the seam between the door and the door frame;

causing the piercing edge to thrust between the door and the door frame;

advancing the door and door frame along the splitting edge creating a gap, the gap having a width;

rotating the striking apparatus by means of the handle whereby the gap width increases;

separating the at least one fastening mechanism from the at least one receiver; and advancing the door through the door frame.

5. The method of claim 4, wherein the second striking means comprises a maul means.

6. The method of claim 5, wherein the head further comprising a second transition portion forming at least two shoulders between the mid portion and the aft portion, each of the at least two shoulders between the mid portion and the aft portion forming second longitudinal shoulders that prevents the mid portion from advancing into an object impacted by second striking means, the second striking means comprising a spike.

7. A method of removing an embedded striking apparatus comprising the steps of:

providing a striking apparatus, the striking apparatus comprising a head, the head comprising a fore portion, a mid portion, and an aft portion, the head further comprising a first transition portion between the mid portion and the fore portion, the first transition portion forming first longitudinal shoulders between the mid portion and the fore portion, the fore portion, mid portion, and aft portion sharing a continuous flat top surface to enable the striking apparatus to be used as a ram, and wherein the continuous flat top surface is planar, the head further comprising a longitudinal journal formed in the mid portion adapted to receive a handle, the fore portion comprising a first striking means, the first striking means comprising a longitudinal arcuate striking face, the longitudinal arcuate striking face at its apex comprising a piercing edge located substantially towards the top of the longitudinal arcuate striking face, the piercing edge tapering into a splitting edge in both directions along the longitudinal arcuate striking face, the longitudinal arcuate striking face extending below the mid portion forming a chin, the fore portion further comprising a first side and a second side, the head further comprising a first channel disposed onto the first side extending from the bottom of the fore portion substantially towards the flat top surface of the fore portion, each of the first longitudinal shoulders between the mid portion and the fore portion forming an arresting surface, substantially perpendicular to the fore portion, wherein the arresting surface prevents the mid portion from advancing into an object impacted by the first striking means, wherein width and height of the arresting surface is equal to the width and height of the mid portion, wherein the first longitudinal shoulders extend vertically between the flat top surface and the bottom of the mid portion, the head further comprising a second channel disposed onto the second side extending from the bottom of the fore portion substantially towards the flat top surface of the fore portion, the second channel with the first channel adapted to receive a forked end of a tool placed against the bottom of the fore portion, the aft portion comprising a second striking means, the striking apparatus further comprising a handle secured within the longitudinal journal;

providing a striking surface;

swinging the striking apparatus by means of the handle;

causing the piercing edge to impact the striking surface whereby the head becomes embedded into the striking surface;

lifting the handle away from the striking surface, whereby the head using the first longitudinal shoulders as fulcra is raised out of the striking surface; and lifting the striking apparatus away from the striking surface.

8. The method of claim 7, wherein the second striking means comprises a maul means.

9. The method of claim 8, wherein the head further comprising a second transition portion forming at least two shoulders between the mid portion and the aft portion, each of the at least two shoulders between the mid portion and the aft portion forming second longitudinal shoulders that prevents the mid portion from advancing into an object impacted by second striking means, the second striking means comprising a spike.

* * * * *